US006220816B1

(12) United States Patent
Nguyen Duc et al.

(10) Patent No.: US 6,220,816 B1
(45) Date of Patent: Apr. 24, 2001

(54) DEVICE FOR TRANSFERRING FLUID BETWEEN TWO SUCCESSIVE STAGES OF A MULTISTAGE CENTRIFUGAL TURBOMACHINE

(75) Inventors: Jean-Michel Nguyen Duc, Vezillon; Philippe Geai, Aubevoye; Jean-Marie Duchemin, Sainte Consorce, all of (FR)

(73) Assignee: Societe Nationale d'Etude et de Construction Moteurs d'Aviation-S.N.E.C.M.A., Paris (FR)

( * ) Notice: Subject to any disclaimer, the term of this patent is extended or adjusted under 35 U.S.C. 154(b) by 0 days.

(21) Appl. No.: 09/215,963

(22) Filed: Dec. 18, 1998

(30) Foreign Application Priority Data

Dec. 19, 1997 (FR) ..... 97 16149

(51) Int. Cl.[7] ..... F01D 1/02
(52) U.S. Cl. ..... 415/199.1; 415/208.2
(58) Field of Search ..... 415/199.1, 199.2, 415/199.3, 208.2, 208.3, 211.1, 211.2, DIG. 914, 185, 186, 187

(56) References Cited

U.S. PATENT DOCUMENTS 3,860,360 1/1975 Yu ..... 415/211
5,595,473 * 1/1997 Nagaoka et al. ..... 415/199.1

FOREIGN PATENT DOCUMENTS 10 61 621 7/1959 (DE) .
0 093 483 11/1983 (EP) .
604 378 9/1945 (GB) .
627 072 1/1947 (GB) .
1 205 514 9/1970 (GB) .

OTHER PUBLICATIONS

Blair, "Compact Diffusers for Centrifual Compressors", Journal of Aircraft, vol. 19, No. 1, Jan. 1982 pp. 46–51.

* cited by examiner

*Primary Examiner*—F. Daniel Lopez
*Assistant Examiner*—James M McAleenan
(74) *Attorney, Agent, or Firm*—Weingarten, Schurgin, Gagnebin & Hayes LLP

(57) ABSTRACT

The fluid transfer device comprises a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine. Each return channel is constituted by a continuous shaped individual tubular element. A first continuous return channel is defined by a set of varying sections defined by parameters and extending normally to a mean line situated in a predefined plane ($P_1P_2P_3$) containing the axis of the machine. The mean line has a rectilinear first portion, a curved second portion forming a circular arc of radius $R_{co2}$, and a rectilinear third portion. The various return channels are identical and can be derived one from another by rotation about the axis of the turbomachine.

14 Claims, 10 Drawing Sheets

DEVICE FOR TRANSFERRING FLUID BETWEEN TWO SUCCESSIVE STAGES OF A MULTISTAGE CENTRIFUGAL TURBOMACHINE

FIELD OF THE INVENTION

The present invention relates to a device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine.

PRIOR ART

FIG. 3 shows an example of a known multistage turbopump as fitted to the cryogenic rocket engines known under the name Vulcain, and it serves to feed those engines with liquid hydrogen. The turbopump of FIG. 3 comprises, inside a case 301, 302: a two-stage centrifugal pump, each stage comprising a respective impeller 305, 355 fitted with respective blades 306, 356 and secured to a common central rotary shaft 322. An inducer 331 conferring good suction characteristics and making possible a high speed of rotation, of about 35,000 revolutions per minute (rpm), is placed at the inlet of the pump on the working fluid feed duct. Turbine elements 332, 333 fed with a flow of hot gases admitted via a torus 334 are secured to the central shaft 322 to drive it together with the impellers 305, 355, and are disposed behind the second stage of the pump.

The central shaft 322 is supported by ball bearings 323 and 324 disposed respectively at the front and at the rear of the assembly constituted by the two-stage pump and the turbine. References 310 and 304 designate respective link ducts between the outlet of the first stage of the pump and the inlet to the second stage of the pump, and the duct for delivering the working fluid from the outlet of the second stage of the pump, a diffuser 307 being disposed at the inlet of the toroidal delivery duct 304.

The link ducts 310 are formed through the body of an inter-stage stator and are made up in three portions: a radial diffuser 308 having thick blades, a return bend 309 without blades, and a centripetal rectifier 311 having return blades. That solution provides good hydraulic performance providing the radial diffuser 308 is large enough, thereby giving rise to considerable radial bulk. The losses caused by the sudden change in section at the outlet from the radial diffuser 308 and by incidence at the inlet to the centripetal rectifier 311 are difficult to control. To obtain sufficient efficiency, the diffuser 308 must therefore be long in the radial direction of the machine. The non-bladed bend 309 contributes neither to reducing the tangential speed nor to mechanical strength. The rectifier 311 needs to be properly set in terms of incidence. As a result it is relatively complex to make the link ducts for the embodiment shown in FIG. 3 and it is not possible to obtain good compactness.

The inter-stage stator which picks up the flow leaving a first centrifugal impeller at high speed and which rectifies it, slows it down, and feeds it to the inlet of a second impeller thus constitutes one of the main elements in the architecture of a multistage turbomachine (centrifugal pump or centrifugal compressor) and determines the radial and axial size of the turbomachine.

OBJECT AND BRIEF DESCRIPTION OF THE INVENTION

The present invention seeks to remedy the above-specified drawbacks and to enable an inter-stage fluid transfer device to be made that provides good control of the flow all along its path, that is of limited size, particularly in the radial direction, and that simplifies manufacture while also reducing mechanical stresses.

These objects are achieved by a device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius $R_{CO2}$ and a rectilinear third portion, and wherein the various return channels are identical and derived from one another by rotation about the axis of the turbomachine.

Preferably, the mean line of the first return channel further comprises a fourth portion having a large radius of curvature $R_{CO1}$ oriented in the opposite direction to the curved second portion to bring the orientation of the mean line parallel to the axis of the turbomachine.

A continuous return channel of the invention makes it possible to control the flow all along its path.

By identifying a mean line contained in a plane, it is possible to simplify the design and the manufacture of a channel by making it possible in relatively simple and analytic manner to describe channel shapes which guarantee minimum bulk and optimized channel operation, in particular by avoiding any sudden changes of direction and by ensuring that flow diffusion takes place for the most part in rectilinear portions situated on either side of the deflector bend.

More particularly, the mean line of the first continuous return channel is contained in a plane ($P_1P_2P_3$) predefined by a first point $P_1$, a second point $P_2$, and a third point $P_3$ such that the first and second points $P_1$, $P_2$ are contained in a plane normal to the axis of the turbomachine, the second and third points $P_2$, $P_3$ are contained in a plane containing the axis of the turbomachine, the position of the first point $P_1$ is determined to correspond to the imposed distance between the inlet of the first channel and the outlet of the centrifugal impeller situated facing it, and the orientations of the vector $P_1P_2$ defined by the first and second points $P_1$, $P_2$ and of the vector $P_2P_3$ defined by the second and third points $P_2$, $P_3$ correspond respectively to the orientation of the rectilinear first portion and to the orientation of the rectilinear third portion of the mean line of the first continuous return channel.

In a fluid transfer device of the invention, the axially terminating end portions of the continuous return channels do not have blades.

This avoids peripheral secondary flows forming which would otherwise generate distortion in the flow at the inlet to the second impeller.

In a particular aspect of the invention, the sections normal to the mean line of the first continuous return channel are defined by their areas, by form factors A, B, and m, and by their angles of orientation $\alpha$ between the local axis of each section and the normal $\bar{b}$ to the predefined plane ($P_1P_2P_3$).

By way of example, the shapes of the sections normal to the mean line of the first continuous return channel are defined by the formula:

$$\frac{x^m}{A^m} + \frac{y^m}{B^m} = 1$$

where A, B, and m are parameters representing form factors.

The continuous return channels of the invention lend themselves well to parametric description.

Thus, in a particular embodiment, the mean line of a continuous return channel contained in the predefined plane ($P_1P_2P_3$) is defined by the following parameters:

$R_0$=mean radius of the fluid transfer device at the inlet of the continuous return channel;

$\beta_0$=the angle of the mean line of the channel at said inlet relative to the tangent to the circle defined by the mean radius $R_0$;

$b_0$=the width of the continuous return channel at said inlet;

$R_2h$=the radius of the hub at the inlet to the other impeller situated in register with the outlet of the continuous return channel;

$R_2t$=the radius of the case at the inlet to the other impeller;

$l_c$=the axial length of the continuous return channel;

$R_{CO1}$=the radius of curvature of the curved fourth portion of the mean line;

$R_{CO2}$=the radius of curvature of the curved second portion of the mean line;

$\phi_m$=the angle of inclination of the mean line of the continuous return channel in a meridian plane of the turbomachine; and $l_{ax}$=the axial distance between the center of curvature of the curved fourth portion of the mean line and the outlet of the continuous return channel.

According to a particular characteristic of the invention, to determine the mean line of the first continuous return channel an absolute coordinate system ($O_{xyz}$) is defined so that $O_z$ corresponds to the axis of the turbomachine, $O_x$ is parallel to the axis of the rectilinear first portion of said mean line, and the origin O of the axis $O_z$ corresponds to the plane of the inlet of the first continuous return channel, the coordinates of the first, second, and third points $P_1$, $P_2$, $P_3$ defining the predefined plane ($P_1P_2P_3$) are determined, and particular points $L_1$, $L_2$, $L_5$, $L_6$, $L_7$ of the mean line are determined so that the particular point $L_1$ corresponds to the inlet, the particular point $L_2$ corresponds to the transition between the rectilinear first portion and the curved second portion, the particular point $L_5$ corresponds to the transition between the curved second portion and the rectilinear third portion, the particular point $L_6$ corresponds to the end of the rectilinear third portion and to the outlet of the continuous return channel, and the particular point $L_7$ corresponds to the inlet of the other centrifugal impeller within a common zone defined by two axially-symmetrical surfaces constituted by the hub and the case at the inlet of the other impeller.

More particularly, the areas of the sections normal to the mean line of the first continuous return channel are defined: at the particular point $L_1$, as a function of the dimensions of the inlet of the continuous return channel; and at the particular point $L_7$, as a function of said hub radius $R_2h$ and of said case radius $R_2t$ at the inlet to the other impeller; the sections normal to the mean line in the curved second portion are of constant area equal to approximately twice the area of the section at the particular point $L_1$; and the areas of the sections normal to the mean line in the rectilinear first portion and in the rectilinear third portion vary in linear manner along the mean line.

According to another advantageous characteristic, at each point of the mean line of a continuous return channel contained in the predefined plane ($P_1P_2P_3$), the orientation of the varying section is defined locally by the angle $\alpha$ between the local axis $\bar{e}$ of the section, and the normal $\bar{b}$ to the predefined plane ($P_1P_2P_3$) containing the mean line, the angle $\alpha$ has a value lying in the range 30° to 35° at the particular points $L_1$ and $L_6$, and a value zero at the particular points $L_2$ and $L_5$, and the angle $\alpha$ varies linearly between the following successive pairs of particular points: $L_1$ and $L_2$, $L_2$ and $L_5$, and $L_5$ and $L_6$.

The varying section of a continuous return channel is substantially rectangular at the particular points $L_1$ and $L_6$, and is elliptical at the particular points $L_2$ and $L_5$.

The fluid transfer device of the invention may comprise 8 to 15 continuous return channels.

BRIEF DESCRIPTION OF THE DRAWINGS

Other characteristics and advantages appear from the following description of particular embodiments, given as examples, and with reference to the accompanying drawings, in which.

DETAILED DESCRIPTION OF PARTICULAR EMBODIMENTS

Figure 2:
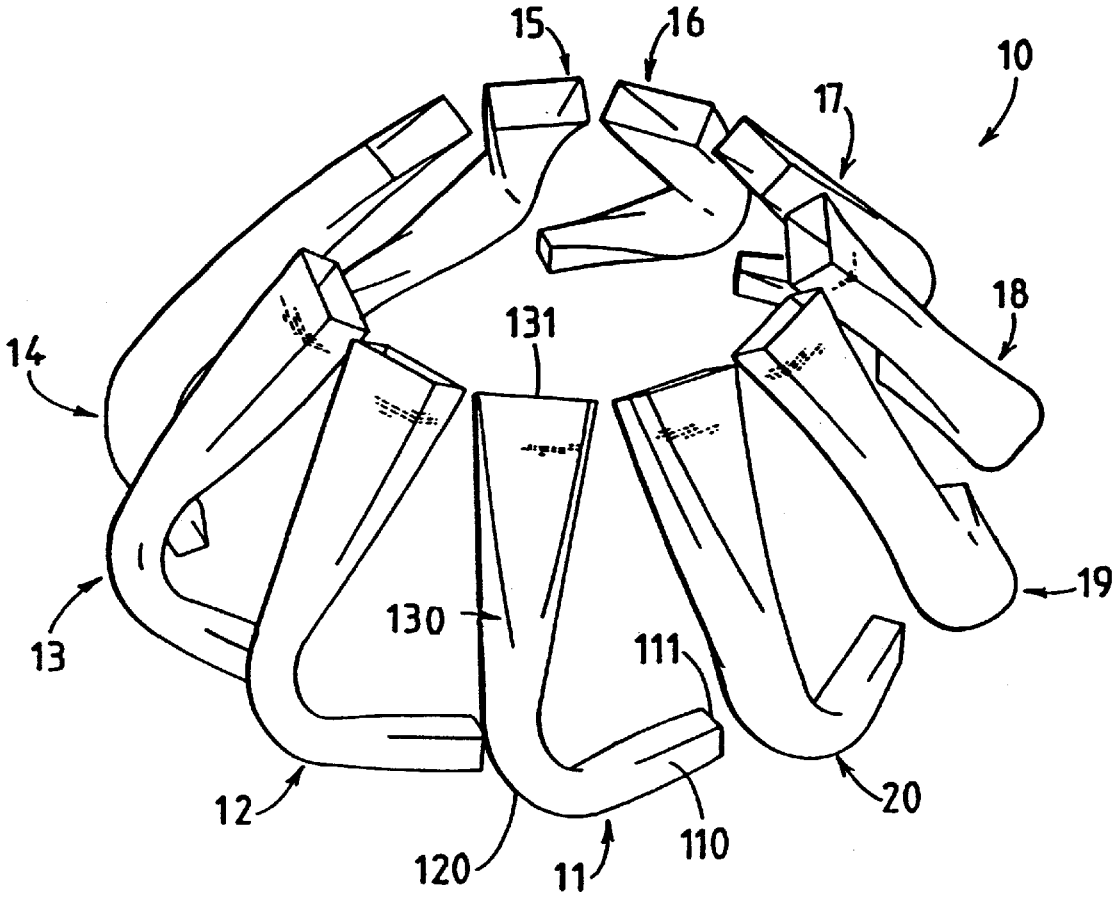
FIG. 2 is a perspective view of a set of individual continuous return channels of a fluid transfer stator device of the invention.

The continuous return channels 11 to 20 shown in particular in FIG. 2, constitute a stator element 10 for a multistage centrifugal pump or centrifugal compressor.

Figure 1:
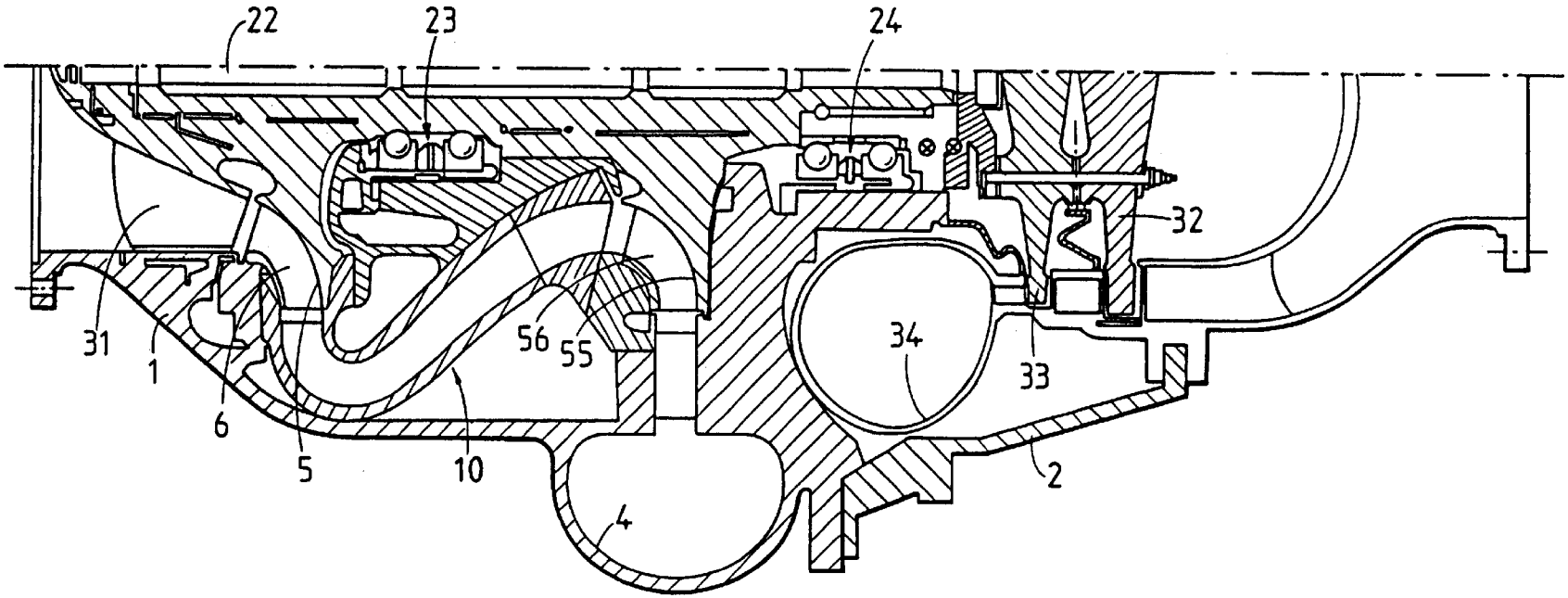
FIG. 1 is an axial half-section view of an example of a high power multistage centrifugal turbopump fitted with an interstage fluid transfer stator device of the invention.

By way of example, FIG. 1 shows a centrifugal turbopump suitable for pumping a cryogenic propellent component such as hydrogen. This two-stage turbopump has a first centrifugal impeller 5 fitted with blades 6 and a second centrifugal impeller 55 fitted with blades 56. A central shaft 22 mounted on ball bearings 23, 24 is rotated by two turbine wheels 32 and 33. The central shaft 22 in turn drives the first and second impellers 5 and 55.

The turbomachine has outer case elements 1, 2, an inducer 31 placed at the inlet of the turbomachine on the path of the fluid to be pumped, a torus 34 for admitting hot gases to drive the turbines 32, 33, and a toroidal working fluid delivery duct 4 disposed at the outlet of the second stage of the pump. Reference 10 designates the interstage stator which comprises a set of continuous return channels 11 to 20 that pick up the flow leaving the first centrifugal impeller 5 at high speed for the purposes of rectifying it, slowing it down, and bringing it to the inlet of the second impeller 55.

The transformation of dynamic pressure at the outlet from the first impeller 5 into static pressure at the inlet of the second impeller 55 is measured by the static pressure recovery coefficient $C_p$ which is defined by the following equation:

$$C_p = \frac{SP_{I2} - SP_{01}}{\frac{1}{2}\rho V_{01}^2}$$

where:

$SP_{O1}$=static pressure at the outlet of the first impeller $SP_{I2}$ =static pressure at the inlet to the second impeller $V_{O1}$=outlet speed from the first impeller ρ=density of the fluid.

Figure 3:
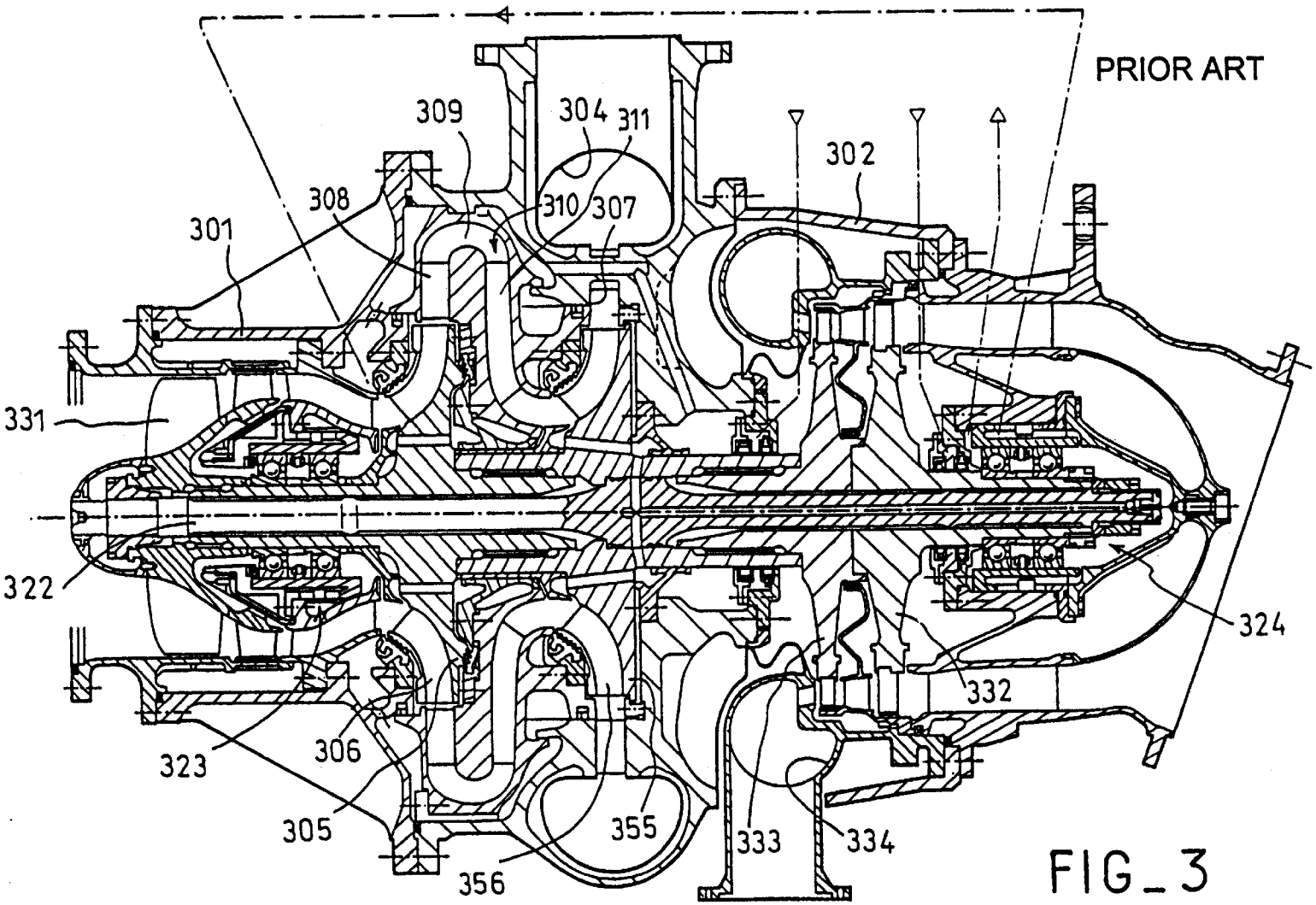
FIG. 3 is an axial section view of a high power multistage centrifugal turbopump fitted with a known stator device for transferring fluid between two stages of the turbopump.

Continuous return channels 11 to 20 of the present invention makes it possible to obtain static pressure recovery coefficients $C_p$ lying in the range 0.7 to 0.8, whereas prior art return channels, as shown in FIG. 3, can obtain values no better than about 0.6 for the static pressure recovery coefficient $C_p$.

Reference is now made essentially to FIGS. 4 to 13 which show the various parameters enabling the three-dimensional shape of a continuous return channel of the invention to be defined so as to enable fluid flow to be controlled all along its path between the outlet from the first impeller 5 and the inlet to the second impeller 55.

The configuration of a first continuous return channel 11 which is implemented in the form of a tube is described below in detail. The other return channels 12 to 20 are then made in identical manner to the first channel 11 and they are distributed regularly around the axis $O_z$ of the turbomachine. Each return channel 12 to 20 is thus derived from the first channel 11 merely by rotation about the axis $O_z$.

The number of continuous return channels can be quite high, lying for example in the range 8 to 15. Manufacture is made easier by making a set of individual tubular elements rather than by machining a solid body. Furthermore, the continuous return channels have varying sections that are simple in shape and that lend themselves well to being made by molding. Finally, the presence of rectilinear lengths in the vicinity of the free ends of the return channels facilitates inspection during manufacture.

According to an essential characteristic of the invention, the shape of a continuous return channel 11 to 20 is given by a mean line 140 contained in a predefined plane $P_1P_2P_3$. The mean line 140 is defined so as to minimize size in the radial direction and so as to adapt the axial size of the interstage stator element 10 as a function of the members (bearing 23, gasket, . . . ) placed behind the first impeller 5 (see FIG. 1).

The mean line 140 contained in a plane and defined for a first individual channel 11 enables the shapes of the various portions of the channel 11 to be described in relatively simple and analytic manner, thus making it possible to benefit from test results obtained on fragmentary basic configurations (rectilinear diffusers, plane bends of various shapes). The mean line 140 is also defined in such a manner as to avoid sudden changes of direction and so as to ensure that the flow is controlled both in the diffusion zones and in the bend portions.

The plane containing the mean line 140 is predefined for a first channel 11 by points $P_1$, $P_2$, and $P_3$ (FIGS. 4 and 7 to 10).

The points $P_1$ and $P_2$ are contained in a plane normal to the axis $O_z$ of the turbomachine. The orientation of the vector $P_1P_2$ gives the mean direction of the first portion 141 of the mean line 140 which defines a rectilinear first length of channel 110 that provides diffusion. The orientation of the vector $P_1P_2$ thus depends mainly on the flow upstream from the interstage fluid transfer device. The position of the point $P_1$ is determined by the distance set for the gap between the inlet 111 of channel 11 and the outlet of the centrifugal impeller 5.

Figure 4:
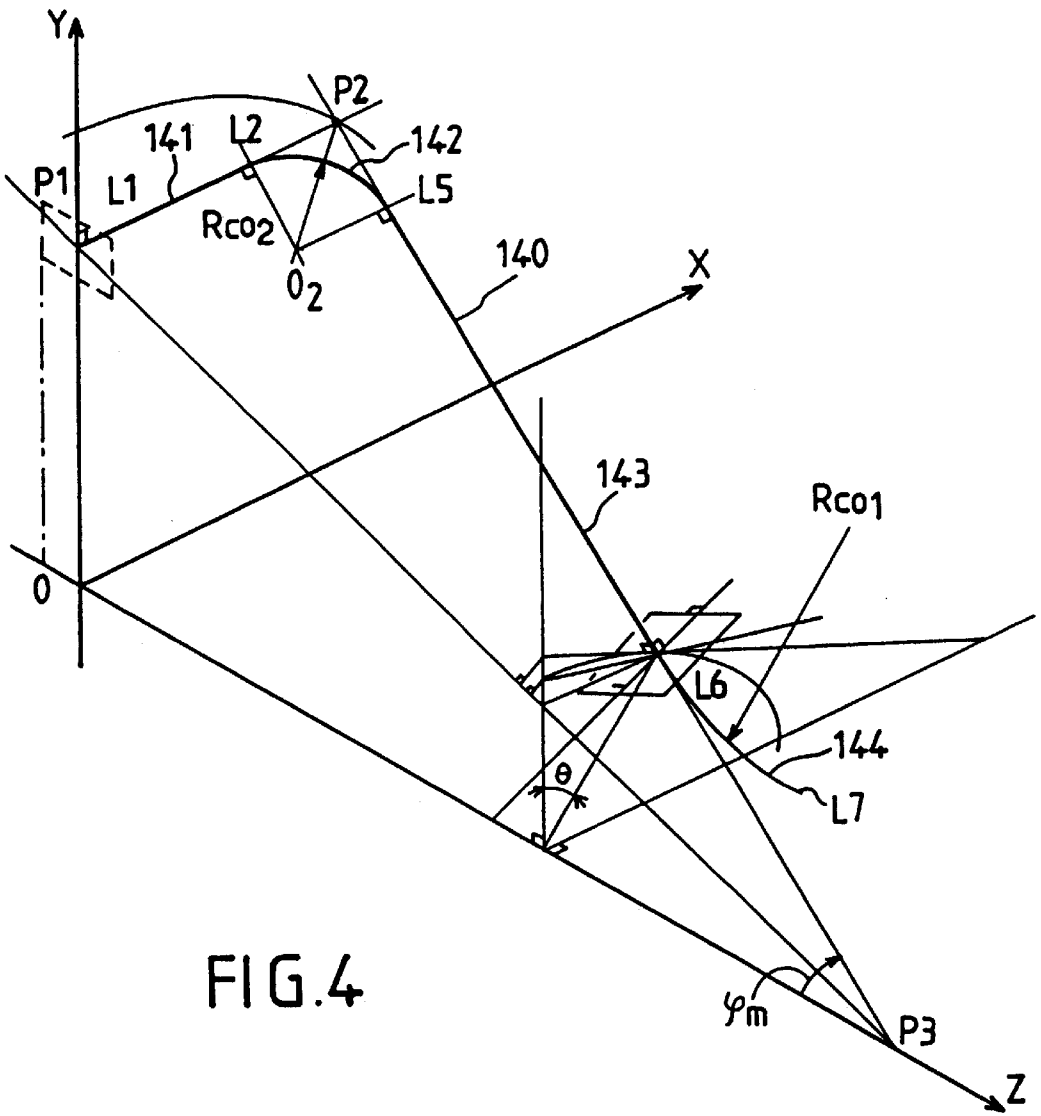
FIG. 4 is a diagram showing, in a three-dimensional coordinate system, the mean line of a continuous return channel of a fluid transfer device of the invention.
Figure 5:
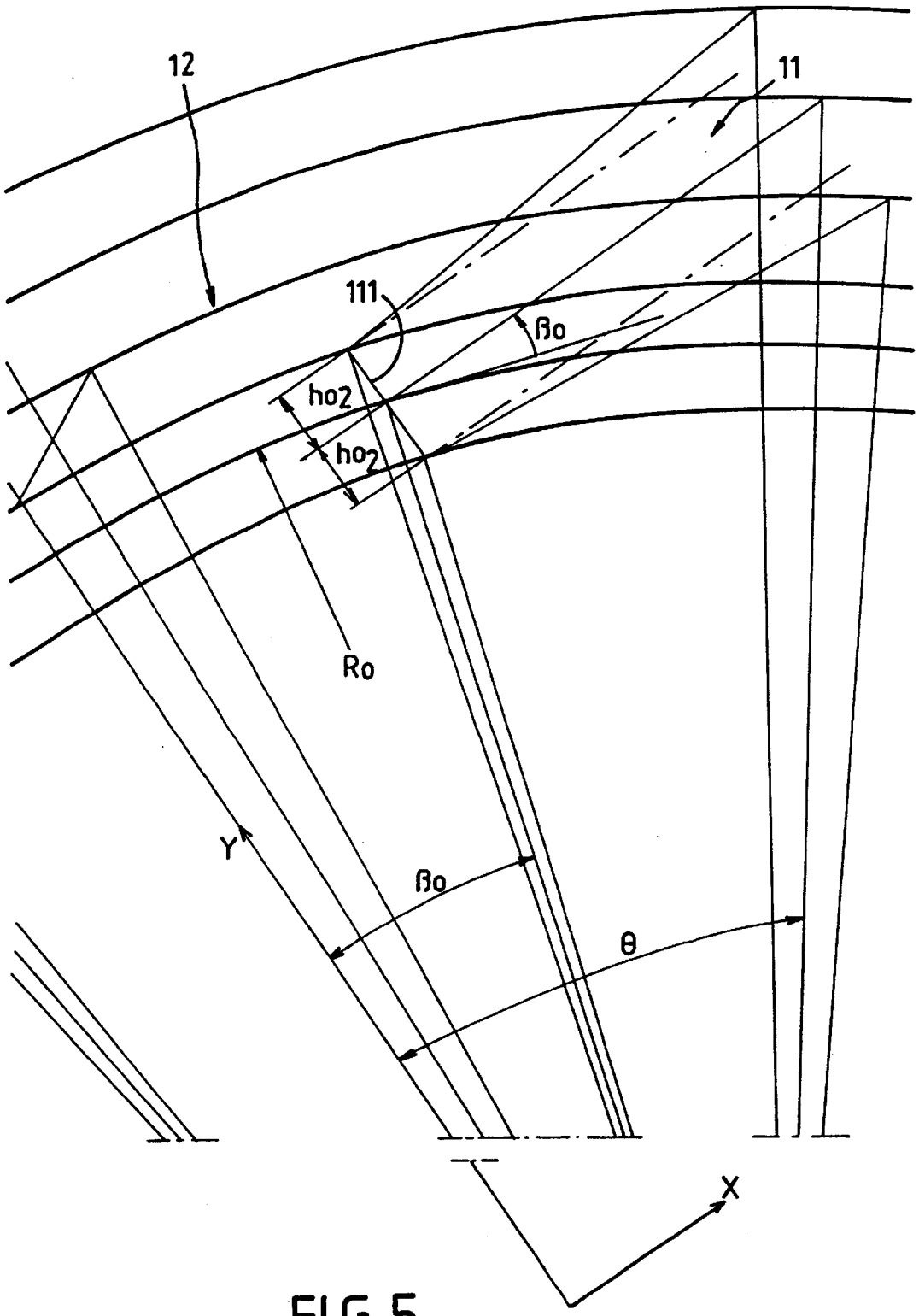
FIG. 5 is a view showing the three-dimensional positioning of the return channel inlets in a device of the invention.

The points $P_2$ and $P_3$ are contained in a plane containing the axis $O_z$ of the turbomachine. The orientation of the vector $P_2P_3$ gives the mean direction of the third portion 143 of the mean line 140 which defines a rectilinear third length of channel 130 that provides diffusion, with the rectilinear first and second lengths of channel 110, 130 being united by a third channel length 120 having the shape of an optimized bend corresponding to a second portion 142 of the mean line 140 (FIGS. 2 and 4).

In the plane $P_1P_2P_3$ defined as specified above, the mean line 140 of a first return channel 11 is itself defined by various characteristic points $L_1$ to $L_7$.

The point $L_1$ is situated at the inlet 111 of the return channel 11. The mean line 140 is rectilinear in its portion 141 situated between points $L_1$ and $L_2$. The mean line 140 is constituted by an arc of a circle centered on $O_z$ and of radius $R_{CO2}$ in its portion 142 situated between points $L_2$ and $L_5$. Intermediate points $L_3$ and $L_4$ can be defined as corresponding respectively to points that are at 40° and at 90° around the circular arc 142. The mean line 140 is rectilinear in its portion 143 situated between the point $L_5$ and the point $L_6$ which constitutes the outlet 131 of the channel 11 (FIGS. 4, 7 to 10, and 13). Between the points $L_6$ and $L_7$, the mean line 140 describes an arc of a circle 144 in the plane (O, $P_2$, $P_3$) of radius $R_{CO1}$ so as to become parallel with the axis $O_z$ of the turbomachine. The point $L_7$ corresponds to the inlet of the second impeller 55 and lies within a common zone defined by two axially-symmetrical surfaces constituted by the case and the hub at the inlet to the second impeller 55.

The axial connection at the outlet from the return channel 11 is not bladed in the portion 144 of the mean line 140, thus avoiding the formation of peripheral secondary flows that might otherwise generate distortion in the flow at the inlet to the second impeller 55.

The sections of the return channel 11 normal to its mean line 140 vary and are defined by their areas, by three form factors A, B, and m, and by the orientation between the local axis of the section and the normal $\overline{b}$ to the plane $P_1P_2P_3$.

The way the section varies is such as to ensure that total pressure gradients are minimized. The sections are simple in shape. Thus, the varying section of the channel 11 can be almost rectangular at the particular points $L_1$ and $L_6$, and can be elliptical at the particular points $L_2$ and $L_5$, with the section varying smoothly between successive characteristic points $L_1$, $L_2$, $L_5$, and $L_6$.

In general, diffusion takes place for the most part in the rectilinear lengths 110 and 130 of the channel 11, which provides good performance.

The deflection of the flow in the length 120 takes place in a plane bend (portion 142 of the mean line 140). The major axis of each normal section in the bend is normal to the plane $P_1P_2P_3$. To optimize performance, it is advantageous to select elliptical normal sections of the bend length 120 having a ratio of major axis divided by minor axis that is equal to 2.

There follows an example of how the mean line 140 contained in the plane $P_1P_2P_3$ can be defined, with reference to FIGS. 4 to 13.

Initially, the flow conditions at the outlet from the impeller 5 are used to calculate values for parameters $R_0$, $\beta_0$, and $b_0$, where:

$R_0$=the mean radius of the fluid transfer device 10 at the inlet 111 of the continuous return channel 11.

$\beta_0$=the angle between the mean line 140 of the channel 11 at the inlet 111 and the tangent to the circle defined by the mean radius $R_0$; and $\beta_0$=the width of the channel 11 at the inlet 111.

For a given machine, the parameters $R_2h$, $R_2t$ and $l_c$ are imposed, where:

$R_2h$=the radius of the hub at the inlet to the impeller 55 situated facing the outlet 131 of channel 11;

$R_2t$=the radius of the case at the inlet to the impeller 55; and $l_c$=the axial length of the channel 11.

Given the constraints on size, the highest possible value is selected for the parameters $R_{CO1}$ and $R_{CO2}$ as defined above.

The parameters $\phi_m$ and $l_{ax}$ are also adjusted to satisfy size constraints while also providing diffusion capacity between the inlet 111 and the beginning of the plane bend 120, where:

$\phi_m$=the angle of inclination of the mean line 140 of the continuous return channel 11 in a meridian plane of the turbomachine; and $l_{ax}$=the axial distance between the center of curvature of the curved fourth portion 144 of the mean line 140 and the outlet 131 of the channel 11.

Once an absolute three-dimensional coordinate system ($O_{xyz}$) has been defined such that $O_z$ corresponds to the axis of the turbomachine, with $O_x$ parallel to the axis of the first rectilinear portion 141 of the mean line, and with the origin O of the axis $O_z$ corresponding to the plane of the inlet of the return channel 11, it is possible to determine the coordinates of the points $P_1$, $P_2$, and $P_3$ that define the plane $P_1P_2P_3$, and also of the particular points $L_1$ to $L_7$ of the mean line 140 as defined above.

Figure 6:
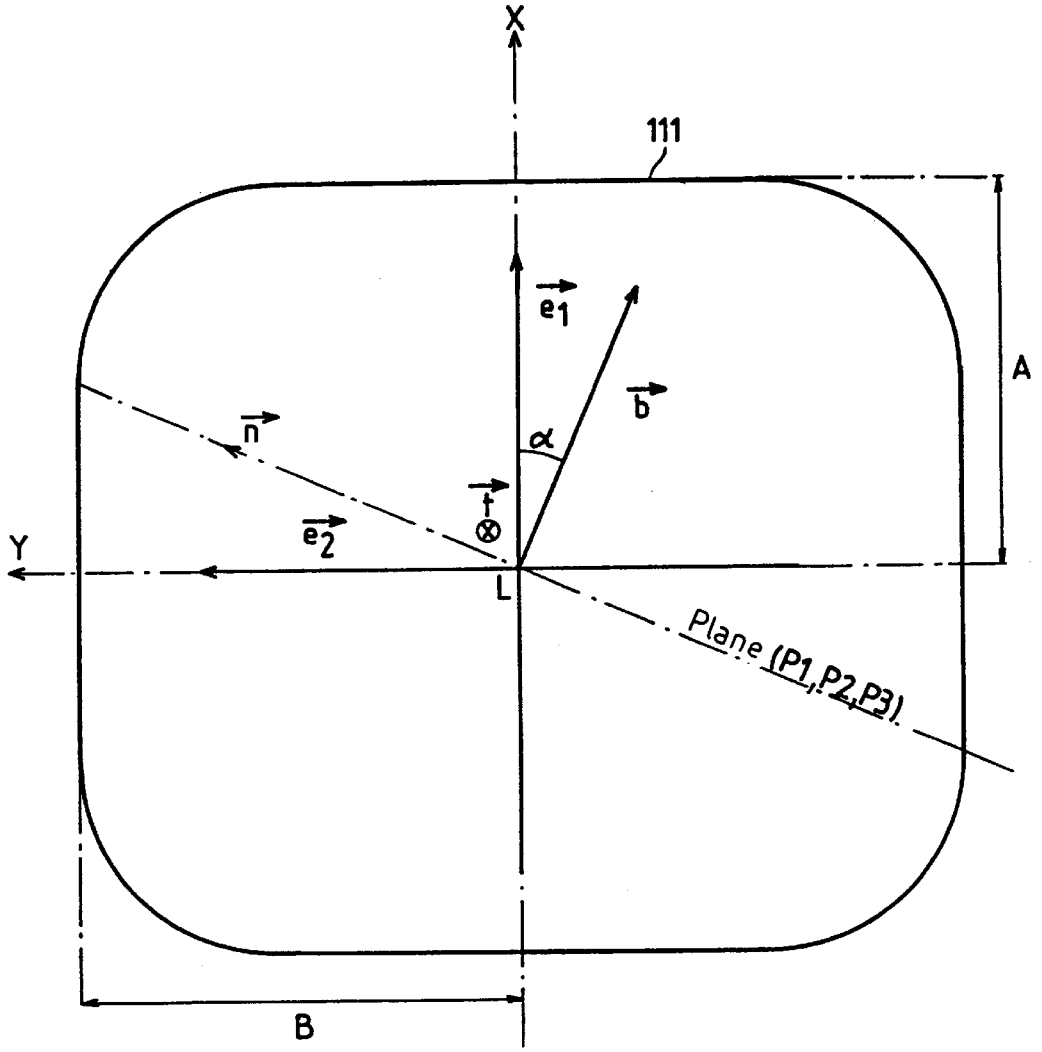
FIG. 6 is a view showing one example of the section of a continuous return channel of a device of the invention.
Figure 10:
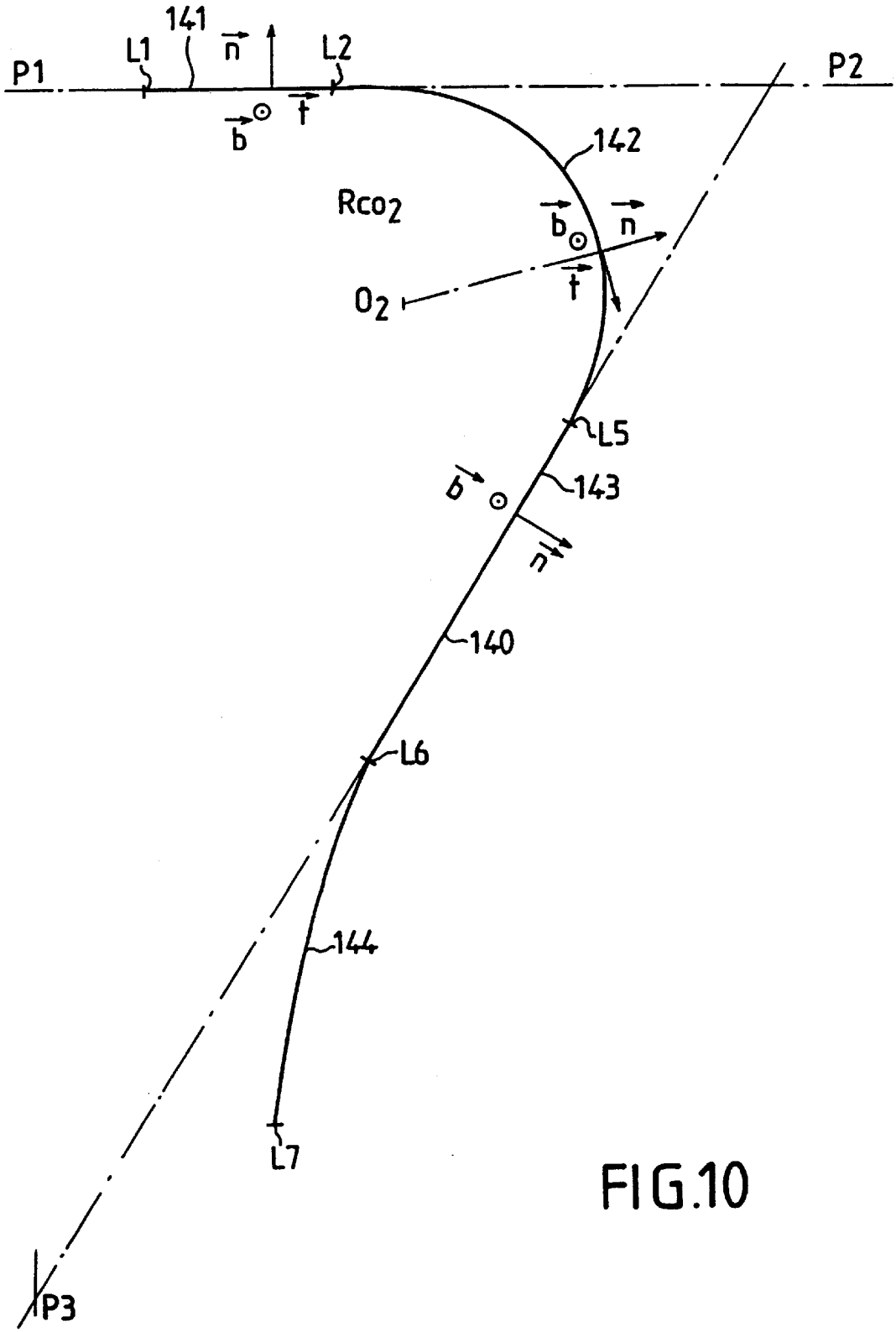
FIG. 10 is a view of the FIG. 4 mean line in the plane containing said line.

The tangent $\bar{t}$, the normal $\bar{n}$, and the normal $\bar{b}$ to the plane $P_1P_2P_3$ can be determined for each of the points of the mean line 140 (see FIGS. 6 and 10).

FIGS. 11 to 13 and FIG. 6 show examples of how the normal sections 112 of the channel 11 can vary at different points along the mean line 140.

Figure 11:
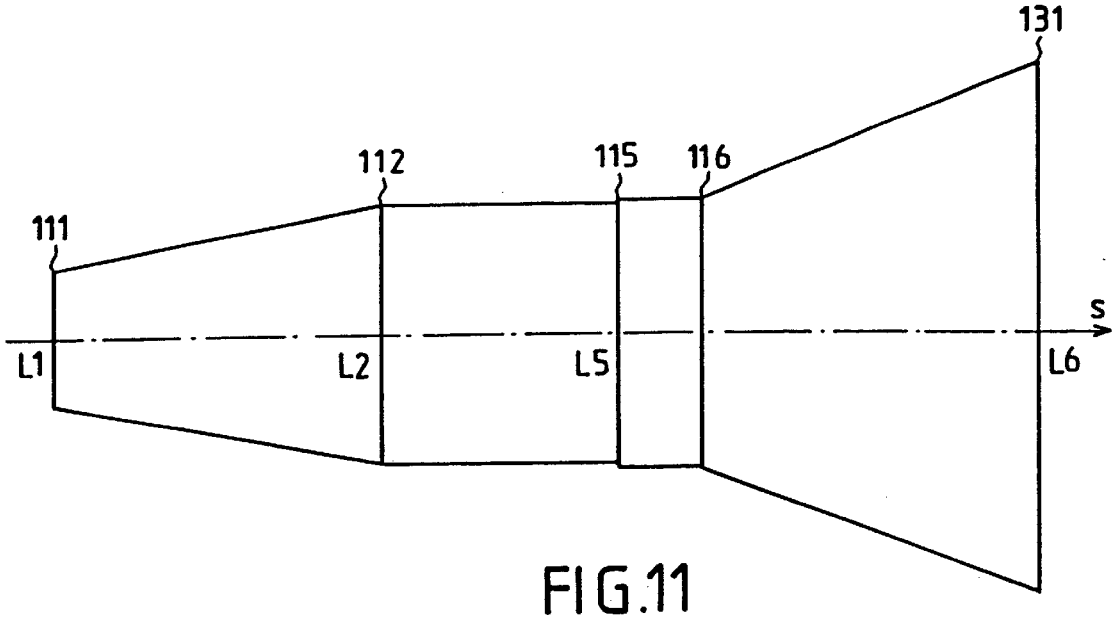
FIG. 11 is a diagram showing one example of how the cross-sectional area of a continuous return channel can vary along the mean line of the channel.
Figure 13:
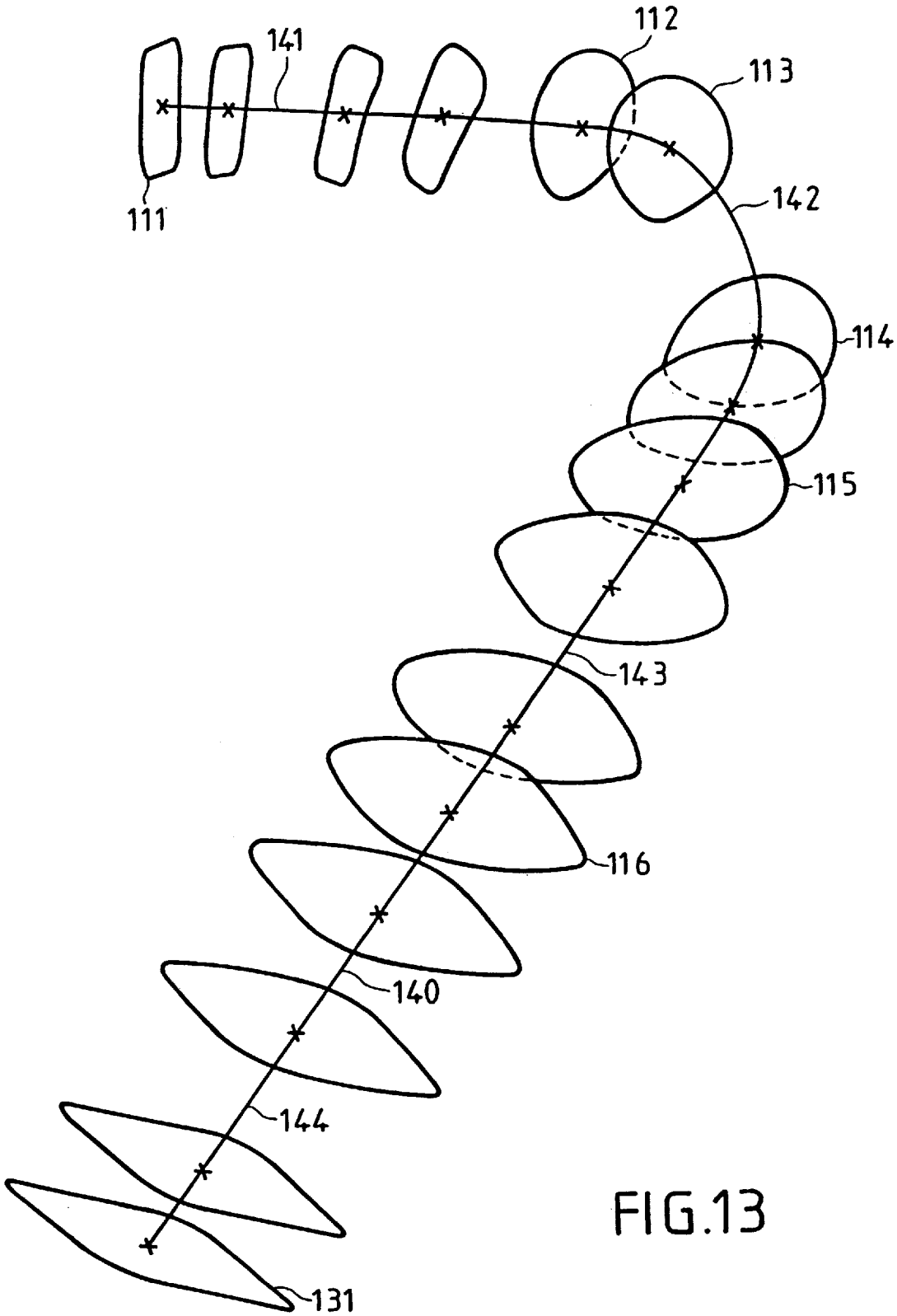
FIG. 13 is a diagrammatic perspective view showing how the section of a continuous return channel can vary along the mean line of the channel.

With reference to FIGS. 11 and 13, the areas of the normal sections 111 to 116 and 131 are defined at the various characteristic points $L_1$ to $L_6$.

The area $S_{L1}$ of the inlet section 111 at point $L_1$ is defined by the inlet, and in particular by its width $b_0$.

The areas $S_{L2}$ to $S_{L5}$ of the sections 112 to 115 at the points $L_2$ to $L_5$ are equal and have a value that is about twice the area $S_{L1}$ of the inlet section 111. The normal sections situated between points $L_1$ and $L_2$ vary in linear manner.

The area $S_{L6}$ of the outlet section 131 at point $L_6$ is defined on the basis of the parameters $R_2t$ and $R_2h$ and its value is likewise about twice the areas of the normal sections situated between the points $L_2$ and $L_5$. The normal sections such as 116 situated between the points $L_5$ and $L_6$ vary in linear manner. Area does not vary between points $L_6$ and $L_7$ (FIG. 10).

The shapes of the sections normal to the mean line 140 can be defined by Fermat curves of the form:

$$\frac{x^m}{A^m} + \frac{y^m}{B^m} = 1$$

where A, B, and m are form factors.

Insofar as the area is imposed, there remain only two degrees of freedom.

Figure 12:
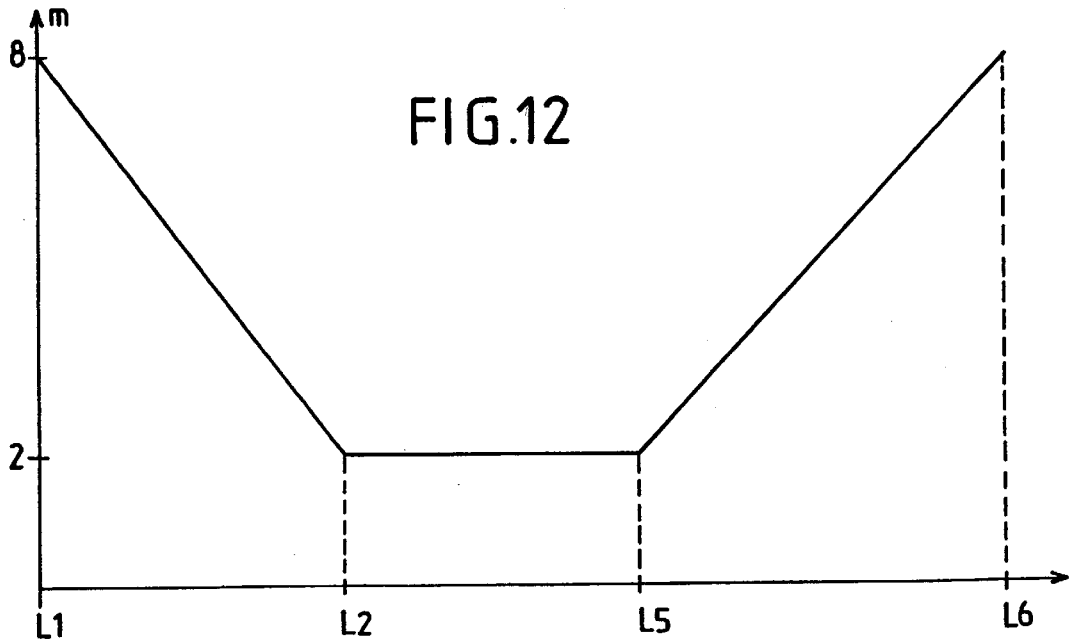
FIG. 12 is a diagram showing how a form factor of the section of a continuous return channel can vary along the mean line of the channel.

FIG. 12 shows one possible way for the parameter m to vary between points $L_1$ and $L_6$. In this particular case, m varies linearly from 8 to 2 between $L_1$ and $L_2$, remains equal to 2 between $L_2$ and $L_5$, and varies linearly from 2 to 8 between $L_5$ and $L_6$.

The normal sections 111 and 131 at points $L_1$ and $L_6$ are almost rectangular.

The normal sections 112 to 115 are elliptical, with the ratio of the semi-major axis B over the semi-minor axis A being equal to 2. More generally, the semi-major axis B varies linearly between the various characteristic points $L_1$ to $L_6$ while the semi-minor axis A is determined as a function of the area and of the value m.

FIG. 6 shows an example of the normal section suitable for the inlet 111. The orientation of each normal section is defined by the angle $\alpha$ between the local axis $\bar{e}$ of the section and the normal $\bar{b}$ to the plane $P_1P_2P_3$ containing the mean line 140 (FIGS. 6, 10 and 13).

The angle $\alpha$ preferably has a value lying in the range 30° to 35° at the particular points $L_1$ and $L_6$, and a value of zero at the particular points $L_2$ and $L_5$. The angle $\alpha$ varies linearly between successive particular points $L_1$ and $L_2$, $L_2$ and $L_5$, and $L_5$ and $L_6$.

Figure 9:
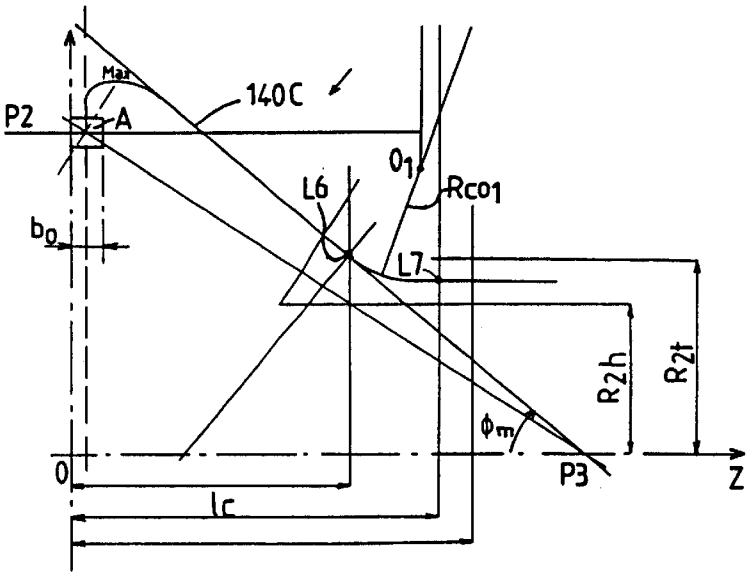
FIGS. 7, 8, and 9 are projections in three dimensions onto various planes of the mean line shown in FIG. 4.
Figure 7:
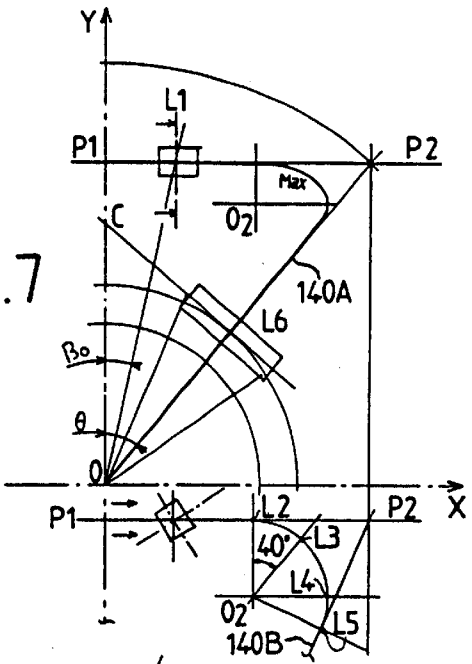
Figure 8:
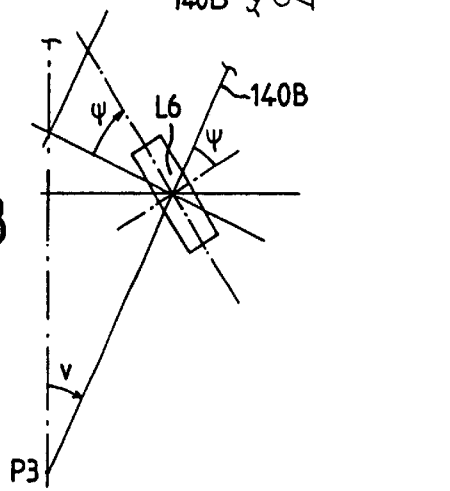

FIGS. 7 to 9, which add to FIGS. 4 and 10 are projections respectively onto the planes $O_{xy}$, $O_{xy}$, and $OP_2P_3$, with the projection of the mean line 140 in these planes being identified by references 140A, 140B, and 140C respectively.

What is claimed is:

1. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius RCO2, and a rectilinear third portion, and wherein the various return channels are identical and derived from one another by rotation about the axis of the turbomachine.

2. A device according to claim 1, wherein the mean line of the first return channel further comprises a fourth portion having a large radius of curvature RCO1 oriented in the opposite direction to the curved second portion to bring the orientation of the mean line parallel to the axis of the turbomachine.

3. A device according to claim 1, wherein the mean line of the first continuous return channel is contained in a plane ($P_1P_2P_3$) predefined by a first point $P_1$, a second point $P_2$, and a third point $P_3$ such that the first and second points $P_1$, $P_2$ are contained in a plane normal to the axis of the turbomachine, the second and third points $P_2$, $P_3$ are contained in a plane containing the axis of the turbomachine, the position of the first point $P_1$ is determined to correspond to the imposed distance between the inlet of the first channel and the outlet of the centrifugal impeller situated facing it, and the orientations of the vector $P_1P_2$ defined by the first and second points $P_1$, $P_2$ and of the vector $P_2P_3$ defined by the second and third points $P_2$, $P_3$ correspond respectively to the orientation of the rectilinear first portion and to the orientation of the rectilinear third portion of the mean line of the first continuous return channel.

4. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius RCO2, and a rectilinear third portion, wherein the various return channels are identical and derived from one another by rotation about the axis of the turbomachine, wherein the mean line of the first return channel further comprises a fourth portion having a large radius of curvature RCO1 oriented in the opposite direction to the curved second portion to bring the orientation of the mean line parallel to the axis of the turbomachine, and wherein the axially terminating end portions of the continuous return channels do not have blades.

5. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius RCO2, and a rectilinear third portion, wherein the various return channels are identical and derived from one another by rotation about the axis of the turbomachine, and wherein the sections normal to the mean line of the first continuous return channel are defined at least in part by their areas, and by their angles of orientation Â between the local axis of each section and the normal b to the predefined plane ($P_1P_2P_3$).

6. A device according to claim 5, wherein the shapes of the sections normal to the mean line of the first continuous return channel are defined by Fermat curves.

7. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius RCO2, and a rectilinear third portion, wherein the various return channels are identical and derived from one another by rotation about the axis of the turbomachine, wherein the mean line of the first return channel further comprises a fourth portion having a large radius of curvature RCO1 oriented in the opposite direction to the curved second portion to bring the orientation of the mean line parallel to the axis of the turbomachine, and wherein the mean line of a continuous return channel contained in the predefined plane ($P_1P_2P_3$) is defined by the following parameters:

$R_0$=mean radius of the fluid transfer device at the inlet of the continuous return channel;

$\beta_0$=the angle of the mean line of the channel at said inlet relative to the tangent to the circle defined by the mean radius $R_0$;

$b_0$=the width of the continuous return channel at said inlet;

$R_2h$=the radius of the hub at the inlet to the other impeller situated in register with the outlet of the continuous return channel;

$R_2t$=the radius of the case at the inlet to the other impeller;

$l_c$=the axial length of the continuous return channel;

$R_{CO1}$=the radius of curvature of the curved fourth portion of the mean line;

$R_{CO2}$=the radius of curvature of the curved second portion of the mean line;

$Ø_m$=the angle of inclination of the mean line of the continuous return channel in a meridian plane of the turbomachine; and $1_{ax}$=the axial distance between the center of curvature of the curved fourth portion of the mean line and the outlet of the continuous return channel.

8. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow tot he inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having as rectilinear first portion, a curved second portion in the form of a circular arc of radius RCO2, and a rectilinear third portion, wherein the various return channels are identical and derived from one another by rotation about the axis of the turbomachine, wherein the mean line of the first return channel further comprises a fourth portion having a large radius of curvature RCO1 oriented in the opposite direction to the curved second portion to bring the orientation of the mean line parallel to the axis of the turbomachine, and wherein, to determine the mean line of the first continuous return channel an absolute coordinate system ($O_{xyz}$) is defined so that $O_z$ corresponds to the axis of the turbomachine, $O_x$ is parallel to the axis of the rectilinear first portion of said mean line, and the origin O of the axis $O_z$ corresponds to the plane of the inlet of the first continuous return channel, the coordinates of the first, second, and third points $P_1$, $P_2$, $P_3$ defining the predefined plane ($P_1P_2P_3$) are determined, and particular points $L_1$, $L_2$, $L_5$, $L_6$, $L_7$ of the mean line are determined so that the particular point $L_1$ corresponds to the inlet, the particular point $L_2$ corresponds to the transition between the rectilinear first portion and the curved second portion, the particular point $L_5$ corresponds to the transition between the curved second portion and the rectilinear third portion, the particular point $L_6$ corresponds to the end of the rectilinear third portion and to the outlet of the continuous return channel, and the particular point $L_7$ corresponds to the inlet of the other centrifugal impeller within a common zone defined by two axially-symmetrical surfaces constituted by the hub and the case at the inlet of the other impeller.

9. A device according to claims 7, wherein, to determine the mean line of the first continuous return channel an absolute coordinate system ($O_{xyz}$) is defined so that $O_z$ corresponds to the axis of the turbomachine, $O_x$ is parallel to the axis of the rectilinear first portion of said mean line, and the origin O of the axis $O_z$ corresponds to the plane of the inlet of the first continuous return channel, the coordinates of the first, second, and third points $P_1$, $P_2$, $P_3$ defining the predefined plane ($P_1P_2P_3$) are determined, and particular points $L_1$, $L_2$, $L_5$, $L_6$, $L_7$ of the mean line are determined so that the particular point $L_1$ corresponds to the inlet, the particular point $L_2$ corresponds to the transition between the rectilinear first portion and the curved second portion, the particular point $L_5$ corresponds to the transition between the curved second portion and the rectilinear third portion, the particular point $L_6$ corresponds to the end of the rectilinear third portion and to the outlet of the continuous return channel, and the particular point $L_7$ corresponds to the inlet of the other centrifugal impeller within a common zone defined by two axially-symmetrical surfaces constituted by the hub and the case at the inlet of the other impeller; wherein the areas of the sections normal to the mean line of the first continuous return channel are defined: at the particular point $L_1$, as a function of the dimensions of the inlet of the continuous return channel; and at the particular point $L_7$, as a function of said hub radius $R_2h$ and of said case radius $R_2t$ at the inlet to the other impeller; wherein the sections normal to the mean line in the curved second portion are of constant area equal to approximately twice the area of the section at the particular point $L_1$; and wherein the areas of the sections normal to the mean line in the rectilinear first portion and in the rectilinear third portion vary in linear manner along the mean line.

10. A device according to claim 8, wherein at each point of the mean line of a continuous return channel contained in the predefined plane ($P_1P_2P_3$), the orientation of the varying section is defined locally by the angle $\alpha$ between the local axis $\bar{e}$ of the section, and the normal $\bar{b}$ to the predefined plane ($P_1P_2P_3$) containing the mean line, wherein the angle $\alpha$ has a value lying in the range 30° to 35° at the particular points $L_1$ and $L_6$, and a value zero at the particular points $L_2$ and $L_5$, and wherein the angle $\alpha$ varies linearly between the following successive pairs of particular points: $L_1$ and $L_2$, $L_2$ and $L_5$, and $L_5$ and $L_6$.

11. A device according to claim 8, wherein the varying section of a continuous return channel is substantially rectangular at the particular points $L_1$ and $L_6$, and is elliptical at the particular points $L_2$ and $L_5$.

12. A device according to claim 1, comprising 8 to 15 continuous return channels.

13. A device for transferring fluid between two successive stages of a multistage centrifugal turbomachine, the device comprising a stator assembly incorporating a plurality of return channels which pick up the high speed fluid flow leaving a centrifugal impeller of one stage of the turbomachine for the purpose of rectifying, slowing down, and conveying said flow to the inlet of another centrifugal impeller of an adjacent stage of the turbomachine, wherein each of the return channels is constituted by a continuous shaped individual tubular element, wherein a first continuous return channel is defined by a set of varying sections defined by parameters and normal to a mean line situated in a predefined plane ($P_1P_2P_3$) containing the axis of the turbomachine, the mean line having a rectilinear first portion, a curved second portion in the form of a circular arc of radius RCO2, and a rectilinear third portion, wherein the various return channels are identical and derived from one another by rotation about the axis of the turbomachine, wherein the mean line of the first continuous return channel is contained in a plane ($P_1P_2P_3$) predefined by a first point $P_1$, a second point $P_2$, and a third point $P_3$ such that the first and second points $P_1$, $P_2$ are contained in a plane normal to the axis of the turbomachine, the second and third points $P_2$, $P_3$ are contained in a plane containing the axis of the turbomachine, the position of the first point $P_1$, is determined to correspond to the imposed distance between the inlet of the first channel and the outlet of the centrifugal impeller situated facing it, and the orientations of the vector $P_1P_2$ defined by the first and second points $P_1$, $P_2$ and of the vector $P_2P_3$ defined by the second and third points $P_2$, $P_3$ correspond respectively to the orientation of the rectilinear first portion and to the orientation of the rectilinear third portion of the mean line of the first continuous return channel, wherein the mean line of the first return channel further comprises a fourth portion having a large radius of curvature RCO1 oriented in the opposite direction to the curved second portion to bring the orientation of the mean line parallel to the axis of the turbomachine, and wherein the mean line of a continuous return channel contained in the predefined plane ($P_1P_2P_3$) is defined by the following parameters:

$R_0$=mean radius of the fluid transfer device at the inlet of the continuous return channel;

$\beta_0$=the angle of the mean line of the channel at said inlet relative to the tangent to the circle defined by the mean radius $R_0$;

$b_0$=the width of the continuous return channel at said inlet;

$R_2h$=the radius of the hub at the inlet to the other impeller situated in register with the outlet of the continuous return channel;

$R_2t$ the radius of the case at the inlet to the other impeller;

lc=the axial length of the continuous return channel;

$R_{CO1}$=the radius of curvature of the curved fourth portion of the mean line;

$R_{CO2}$=the radius of curvature of the curved second portion of the mean line;

$Ø_m$=the angle of inclination of the mean line of the continuous return channel in a meridian plane of the turbomachine; and $l_{ax}$=the axial distance between the center of curvature of the curved fourth portion of the mean line and the outlet of the continuous return channel.

14. A device according to claim 8, wherein the areas of the sections normal to the mean line of the first continuous return channel are defined: at the particular point $L_1$, as a function of the dimensions of the inlet of the continuous return channel; and at the particular point $L_7$, as a function of said hub radius $R_2h$ and of said case radius $R_2t$ at the inlet to the other impeller; wherein the sections normal to the mean line in the curved second portion are of constant area equal to approximately twice the area of the section at the particular point $L_1$; and wherein the areas of the sections normal to the mean line in the rectilinear first portion and in the rectilinear third portion vary in linear manner along the mean line.

* * * * *

UNITED STATES PATENT AND TRADEMARK OFFICE

CERTIFICATE OF CORRECTION

PATENT NO. : 6,220,816 B1 
DATED : April 24, 2001
INVENTOR(S) : Jean-Michel Nguyen Duc et al.

It is certified that error appears in the above-identified patent and that said Letters Patent is hereby corrected as shown below:

Column 6,
Line 37, "$O_z$" should read -- $O_2$ --;

Column 7,
Line 21, "$\beta_o$= " should read -- $b_o$= --; and

Column 8,
Line 39, "$O_{xy}$, $O_{xy}$," should read -- $O_{xy}$, $O_{xz}$, --.

Signed and Sealed this

Fifteenth Day of October, 2002

*Attest:*

*Attesting Officer*

JAMES E. ROGAN
*Director of the United States Patent and Trademark Office*